US005507549A

United States Patent [19]

Cope

[11] Patent Number: 5,507,549

[45] Date of Patent: Apr. 16, 1996

[54] CONVERTIBLE FURNITURE

[76] Inventor: Marvin E. Cope, Rd #1, Box 1724, Berwick, Pa. 18603

[21] Appl. No.: 148,288

[22] Filed: Nov. 8, 1993

[51] Int. Cl.[6] ..... A47C 13/00

[52] U.S. Cl. ..... 297/129; 297/124; 297/118; 297/217.1; 297/253

[58] Field of Search ..... 297/1–3, 118, 297/119, 123–125, 129, 135, 140, 170, 173, 188.08, 188.01, 217.1, 253, 256.16, 250.1; 182/28, 29, 33, 33.3, 33.4

[56] References Cited

U.S. PATENT DOCUMENTS

| | | | |
|---|---|---|---|
| 201,930 | 4/1878 | Martin | 297/125 X |
| 910,818 | 1/1909 | Hook | 182/33 X |
| 1,439,437 | 12/1922 | New | 297/125 X |
| 1,635,183 | 7/1927 | Jeannotte | 182/33 |
| 1,719,004 | 7/1929 | Eos | 297/124 X |
| 1,820,904 | 9/1931 | Beck . | |
| 1,937,886 | 12/1933 | Grose . | |
| 1,982,111 | 11/1934 | King . | |
| 2,024,960 | 12/1935 | Allerding . | |
| 2,496,205 | 1/1950 | Grieb | 297/250.1 |
| 2,533,515 | 12/1950 | Scarborough . | |
| 2,553,122 | 5/1951 | Weatherson . | |
| 2,584,642 | 2/1952 | Tuttle . | |
| 2,619,152 | 11/1952 | Lane . | |
| 2,678,084 | 5/1954 | Sykes | 182/33 X |
| 2,691,405 | 10/1954 | Hinch . | |
| 2,814,334 | 11/1957 | Lane | 297/125 |
| 2,963,076 | 12/1960 | Hyman | 182/33 |
| 5,346,279 | 9/1994 | Pecorella | 297/256.16 X |

*Primary Examiner*—Milton Nelson, Jr.
*Attorney, Agent, or Firm*—Charles S. McGuire

[57] ABSTRACT

A furniture item of the type selectively positionable for use as a chair, ironing board or step ladder includes a telephone stand and/or a removably mounted child seat. Cooperatively positioned portions of the child seat and the furniture item prevent forward or rearward movement of the child seat. The telephone stand includes a support surface laterally adjacent and coplanar with the seat of the furniture item when positioned for use as a chair. A lower compartment for a telephone book, or the like, is supported between the legs of the item. A cover of the compartment includes a fixed rear section which forms the lower step when the item is positioned for use as a step ladder.

18 Claims, 4 Drawing Sheets

CONVERTIBLE FURNITURE

BACKGROUND OF THE INVENTION

The present invention relates to an item of furniture convertible to multiple uses and, more particularly, to a furniture item in the nature of a chair having a telephone shelf and notepad holder, a hinged-top storage compartment for a phone book, or the like, and cooperative structure for selectively converting the chair to an ironing board, a step ladder or a child seat.

Many forms of convertible furniture are found in the prior art. For example, U.S. Pat. Nos. 1,937,886, 1,982,111, 2,024,960, 2,533,515 and 2,961,405 disclose furniture items having portions which may be selectively moved to various relative positions to serve as a chair, an ironing board or a step ladder. The furniture item of U.S. Pat. No. 1,820,904 may be arranged as either of a step ladder, a table or an ironing board. U.S. Pat. Nos. 2,553,122, 2,584,642 and 2,619,152 relate to convertible furniture items including, in at least one relative orientation of components, a high chair or child seat.

It is a principal object of the present invention to provide a novel and improved furniture item easily and quickly convertible to serve a variety of functions including chair, ironing board, step ladder and child seat.

A further object is to provide a multi-use furniture item which includes conveniently positioned telephone rest, notepad and pencil/pen holder and storage compartment for use when the item is configured as a chair, but which do not interfere with conversion of the item for use as an ironing board or step ladder.

Another object is to provide a furniture item of the type having two relatively moveable rigid structures for conversion of the item to multiple uses with a child seat selectively mountable thereon in a secure manner without positive attachment means.

Other objects will in part be obvious and will in part appear hereinafter.

SUMMARY OF THE INVENTION

The furniture piece of the present invention comprises a first rigid structure including legs and a seat portion, and a second rigid structure including a plurality of interconnected structural and support members. The first and second structures are hingedly connected for relative movement between a plurality of positions, thereby converting the item to function in several different capacities, e.g., as a chair, an ironing board or a step ladder. In addition, the item advantageously incorporates a telephone support shelf, a compartment having a hinged lid for use in storing a telephone book, or the like, and a child seat selectively mountable upon the furniture item when positioned for use as a chair.

The telephone shelf has an upper surface laterally adjacent and substantially coplanar with the chair seat. The upper surface of the storage compartment hinged lid, when in the closed position, is forwardly adjacent and coplanar with the upper surface of the lower step when the item is positioned for use as a step ladder. Also, the lower step forms a stationary portion of the upper wall of the storage compartment.

The child seat includes seat, back and arm rest portions. When the furniture item is positioned for use as a chair, the child seat may be placed with the lower surface of its seat portion resting upon the upper surface of a portion of the second rigid structure which forms a coplanar continuation of the chair seat. The child seat includes a pair of tabs extending integrally downward on opposite sides of the child's seat back for engagement behind rear edge portions of the aforementioned portion of the second rigid structure. Also, the rear edge of the seat portion of the child seat extends rearwardly from the back portion to engage the surface of the chair back, thereby cooperating with the tabs to provide secure mounting of the child seat on the chair.

The foregoing and other features of the invention will be more readily understood and fully appreciated from the following detailed description of the preferred embodiment, taken in conjunction with the accompanying drawings.

DETAILED DESCRIPTION

Figure 1:
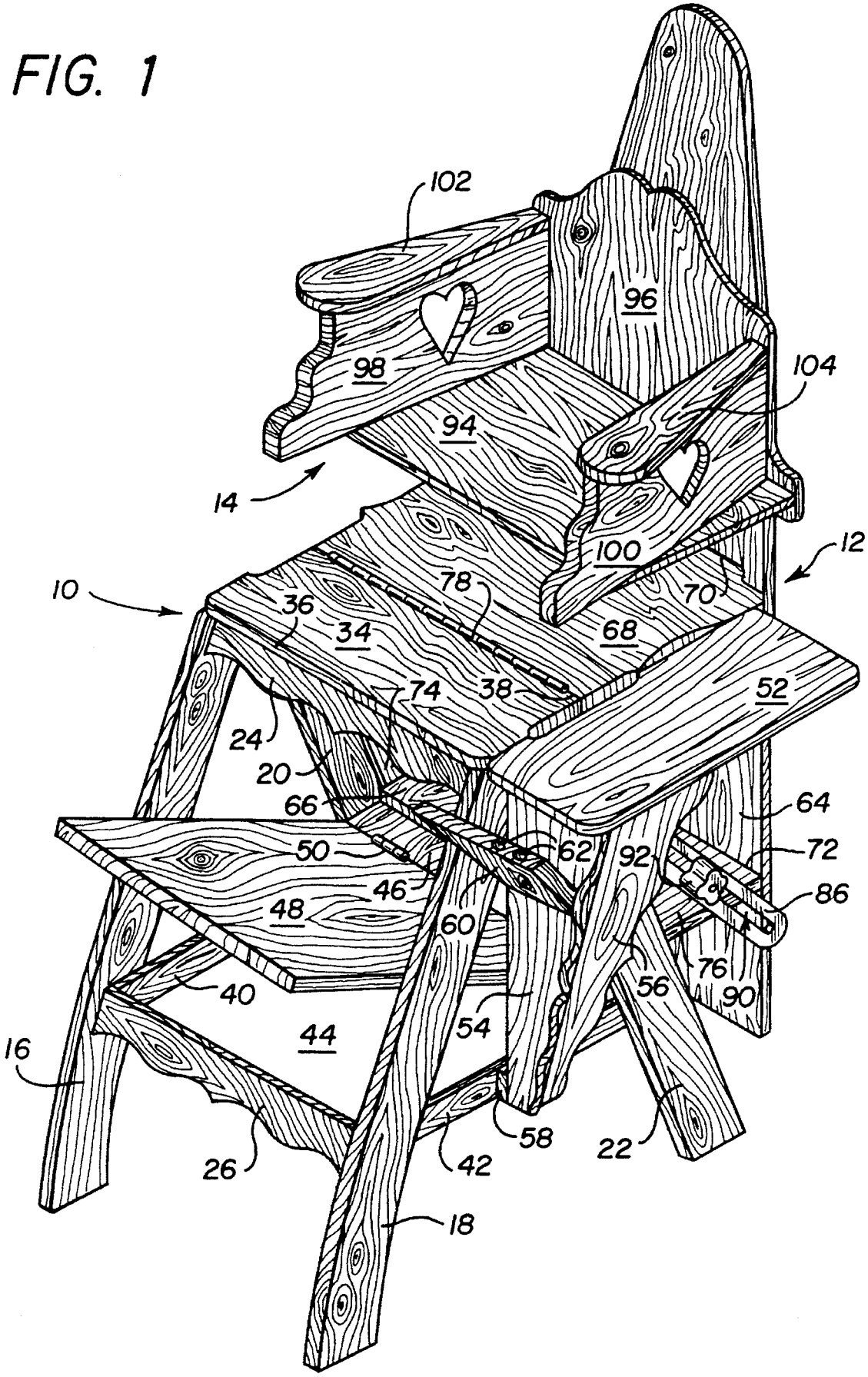
FIG. 1 is a perspective view of the furniture item of the invention with the detachable child seat shown elevated above the structure upon which it may be removably mounted.

Referring now to the drawings, the furniture item of the invention is generally comprised of first and second rigid, structural sections 10 and 12, respectively, and a selectively mountable child seat 14. First rigid structure 10 includes left and right front legs 16 and 18, respectively, and left and right rear legs 20 and 22, respectively. The terms "left" and "right" are used for convenience to denote the relative positions of certain elements as seen from the front of the furniture item, i.e., the side having the two "front" legs. The lower ends of all four legs, of course, lie in a common plane for resting upon a floor or other horizontal surface. Preferably, front legs 16 and 18 are curved rearwardly near their lower ends for space-saving purposes.

Figure 2:
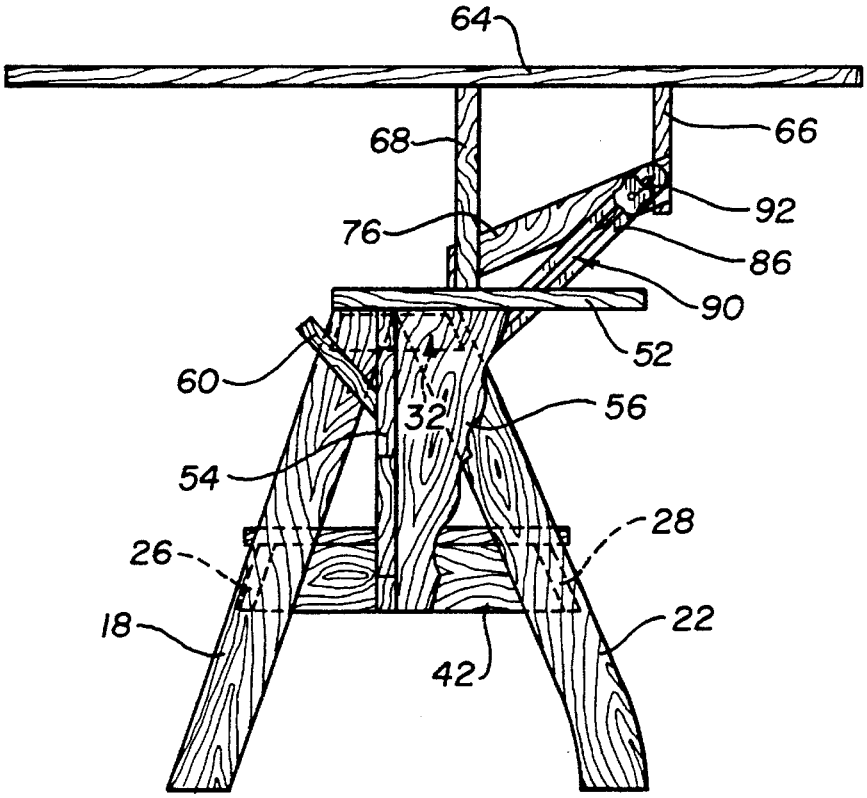
FIG. 2 is a right side elevational view showing the furniture item positioned for use as an ironing board.
Figure 4:
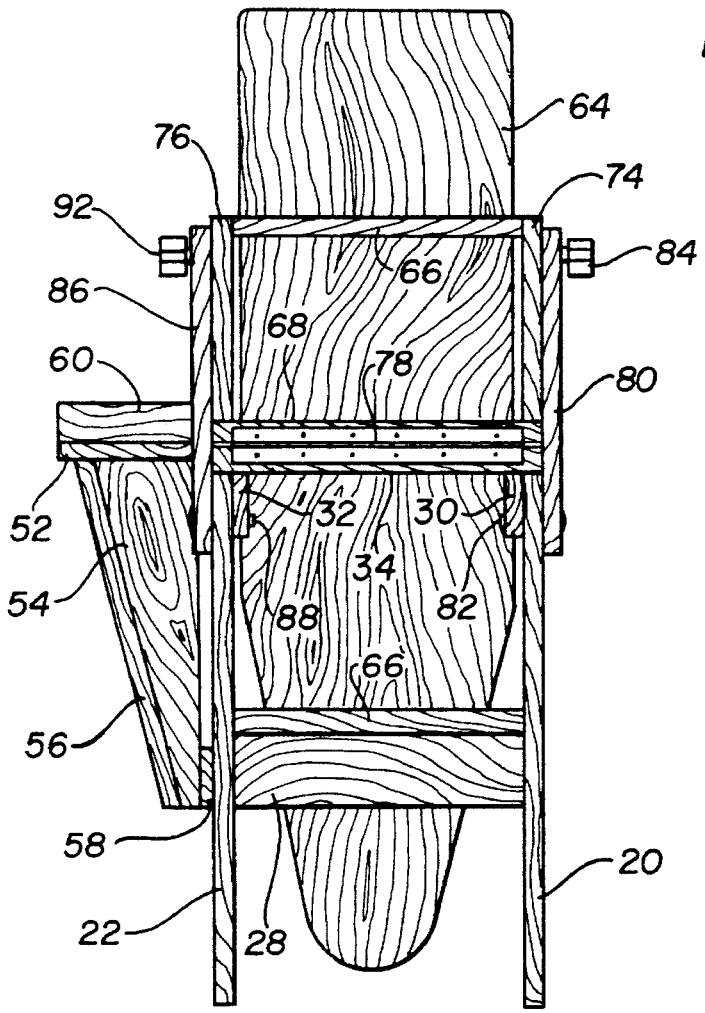
FIG. 4 is a rear elevational view of the furniture item in the position of FIG. 3.

Legs 16, 18, 20 and 22 are rigidly interconnected by suitable frame means. In the illustrated embodiment, front legs 16 and 18 are connected by screws or other suitable fasteners to upper and lower, front frame members 24 and 26, respectively, and rear legs 20 and 22 are connected to rear frame member 28. Left front and rear legs 16 and 20 are both connected near their upper ends and on their inner sides to block 30, and right front and rear legs 18 and 22 are likewise connected to block 32 (FIGS. 2 and 4). Seat portion 34 is affixed to the surfaces of the upper terminal ends of all four legs, and extends between front and rear edges 36 and 38, respectively.

The first rigid structure further includes a storage compartment with a hinged lid and a telephone shelf and memo pad and pencil/pen holder. The front and rear walls of the compartment are provided by frame members 26 and 28, respectively. The compartment further includes left and right side walls 40 and 42, respectively, bottom wall 44, and a two-piece top wall including fixed, rear portion 46 and front portion 48 which is attached by a pair of hinges, one of which is seen in FIG. 1 denoted by reference numeral 50, to rear portion 46 for movement with respect thereto between open and closed positions. The compartment provides handy storage of a telephone book and/or other articles, and the forward, upper surface of front portion 48 serves as a foot rest when the item is used as a chair.

Figure 4A:
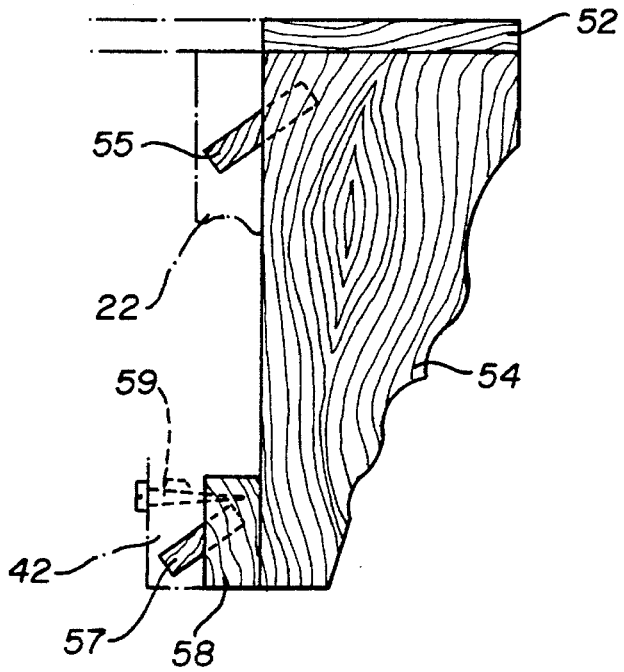
FIG. 4*a* is a front elevational view of the preferred embodiment of the telephone stand portion of the furniture item.

Telephone shelf 52 is mounted upon supports 54 and 56, which are fixedly attached to one another. Support 54 is connected to first rigid structure 10, preferably by means such as illustrated in FIG. 4*a*. Wood dowels 55 and 57 are fixedly secured in openings in support 54 and spacer block 58, respectively, and extend downwardly at 45° angles. Block 58 is fixedly secured to the lower portion of support 54. Appropriate blind holes are provided in leg 22 and compartment side wall 42 for slidingly receiving dowels 55 and 57. Telephone stand 52 and its supporting structure may then be secured to rigid structure 10 by a single wood screw 59, passing through wall 42 and into block 58. In this manner, structure 10 may be prepared to receive a telephone stand on either side. Notepad holder 60 is fixedly attached to the forward surface of support 54 and to leg 18 to extend upwardly at a forwardly disposed angle. Openings 62 are provided in the upper edge of notepad holder 60 to hold pens or pencils.

Second rigid structure 12 includes first, second and third structural members 64, 66 and 68, respectively, each having first and second, opposite, parallel surfaces. First member 64 is elongated with its first surface facing the front in the FIG. 1 position. Edge portions 70 and 72 of second and third members 66 and 68, respectively, are fixedly attached to the first surface of first member 64 in spaced relation, with the first and second surfaces of the second and third members all parallel to one another and perpendicular to the first and second surfaces of the first member. Left and right support members 74 and 76, respectively, are each fixedly attached at opposite ends to the facing surfaces of second and third structural members 66 and 68.

First and second rigid structures 10 and 12 are mutually attached by piano-type hinge 78 which extends across adjacent edges of seat portion 34 and third structural member 68. Left, elongated member 80 is pivotally connected to the first rigid structure by pin 82, which extends through member 80, leg 20 and block 30. Knob 84 has a threaded opening which is engaged with the threaded end of a pin which is fixedly attached to support member 74 and extends through an elongated slot in member 80. Right, elongated member 86 is formed identically to member 80 and connected in the same manner on the opposite side of the furniture item. Pin 88 extends through member 86, leg 22 and block 32 to pivotally connect member 86 near one end thereof to first rigid structure 10. Elongated slot 90 extends longitudinally of member 86, as does the elongated slot (not seen) in member 80. A pin fixed to support member 76 extends through slot 90 to a threaded end engaged by a threaded opening in knob 92.

Figure 3:
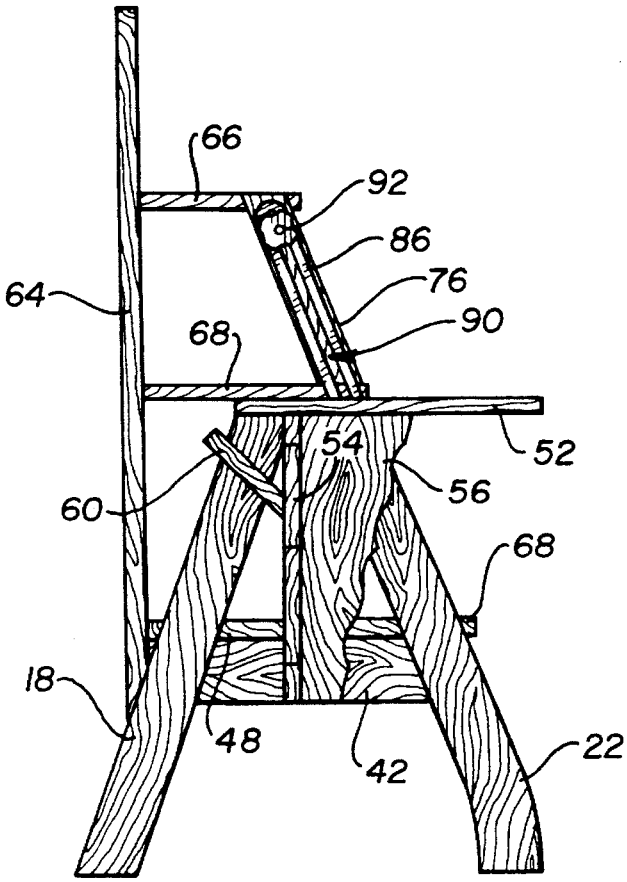
FIG. 3 is a right side elevational view showing the furniture item positioned for use as a step ladder.

First and second rigid structures 10 and 12 may be selectively placed in any of a plurality of relative positions to serve various functions. For example, second structure 12 may be rotated about the axis of hinge 78 to move from the position shown in FIG. 1, wherein member 64 is essentially vertical and positioned at the rear of the furniture item, to the position of FIG. 2, wherein member 64 is horizontal, to the position of FIGS. 3 and 4, wherein member 64 is again vertical but positioned at the front of the furniture item. The elements are releasably held in the position of FIG. 2 by advancing knobs 84 and 92 on their respective threaded pins to frictionally engage elongated member 80 between support member 74 and knob 84, and elongated member 86 between support member 76 and knob 92. When in the FIGS. 1 and 3 positions, the knobs may be loose since these represent the extremes of movement of second rigid structure 12 in each direction. As the second structure is moved to the position of FIGS. 3 and 4, sufficient clearance must be provided between opposing edges of shelf 52 and member 68 and seat portion 34 for passage of elongated members 80 and 86. It will be noted that seat portion 34 is widened adjacent its forward end where no clearance for elongated members 80 and 86 is necessary.

Figure 5:
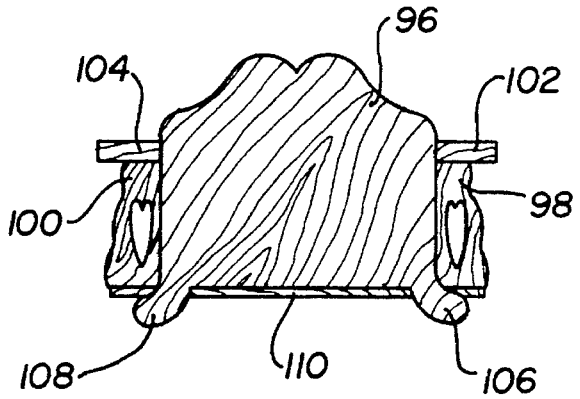
FIG. 5 is a rear elevational view of the detachable child seat.
Figure 5A:
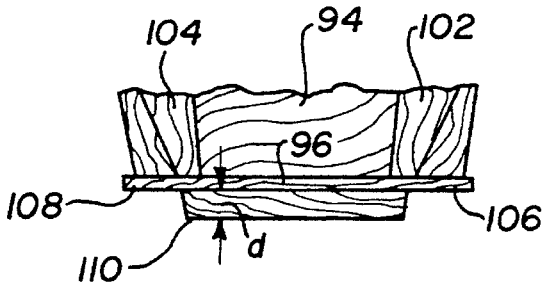
FIG. 5*a* is a fragmentary, top plan view of portions of the child seat.
Figure 6:
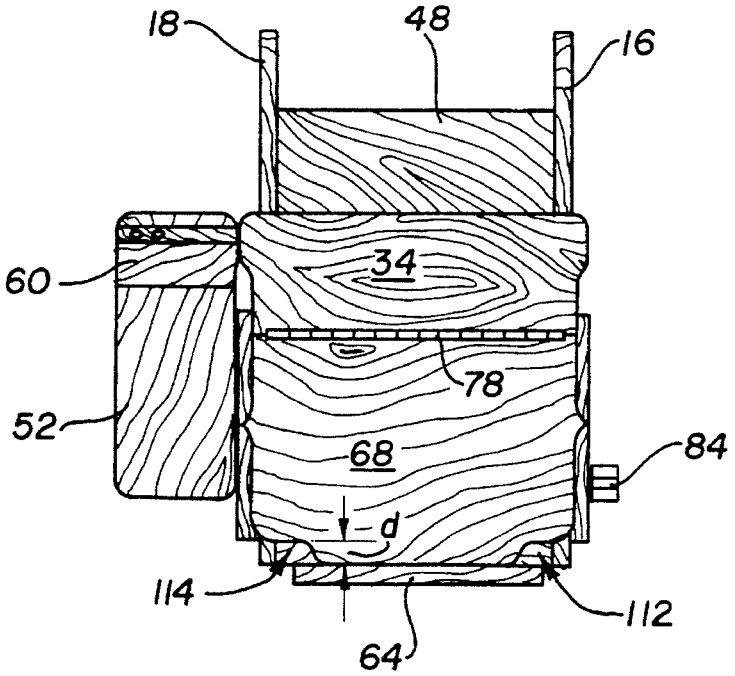
FIG. 6 is a top plan view of the furniture item with the child seat removed.

Child seat 14 includes seat and back portions 94 and 96, respectively, and left and right side panels 98 and 100, respectively, having arm rests 102 and 104 fixedly attached thereto. As best seen in FIGS. 5 and 5a, tabs 106 and 108 extend integrally downward from back portion 96 on both left and right sides of child seat 14. Also, seat portion 94 extends integrally rearwardly, beneath back portion 96 to rear edge 110. As seen in FIG. 6, third structural member 68 includes notches 112 and 114 adjacent each lateral side of rear edge 70 thereof, thus providing marginal rear edge portions forwardly offset from rear edge 70 at which member 68 is attached to first structural member 64. The distance d between rear edge 110 and the rear surface of back portion 96 of the child seat is substantially equal to the distance between rear edge 70 and the marginal rear edge portions adjacent notches 112 and 114, as indicated in FIGS. 5a and 6. Thus, when child seat 14 is placed with seat portion 94 upon the upper surface of member 68 in the FIG. 1 position, a firm engagement is provided so that the child seat cannot move forwardly, rearwardly or laterally.

From the foregoing it will be seen that the furniture item of the invention is extremely versatile and adaptable to many uses. When first and second rigid structures are in the relative positions shown in FIG. 1, they provide a seat with conveniently positioned telephone shelf and notepad holder, and lower storage compartment. Shelf 52 and its supports may, of course, be positioned on the opposite side, as may be preferred by right-handed persons when using the item as an ironing board. In the FIG. 1 position, the upper surface of member 68 forms a continuation of seat portion 34, and compartment cover 48 provides a convenient foot rest. The second structure may be moved to and releasably retained in the FIG. 2 position to serve as an ironing board, and moved to the FIG. 3 position to provide a 3-step ladder. In the latter position, the upper surfaces of compartment cover portions 46 and 48 provide a large and stable lower step, with members 68 and 66 providing the second and third steps, respectively. Moreover, a child seat may be securely mounted upon the second rigid structure when in the FIG. 1 position, although no positive engagement means are necessary.

What is claimed is:

1. A convertible furniture item comprising:

a) a first rigid structure including:

i) a pair of front legs and a pair of rear legs, each of said legs having upper and lower terminal ends, said lower terminal ends lying in a common plane for resting upon a horizontal surface;

ii) frame means rigidly interconnecting said legs with respect to one another; and iii) a first seat portion rigidly affixed with respect to said upper terminal ends and having an upper surface substantially parallel to said common plane;

b) a second rigid structure including:

i) first, second and third structural members, each having first and second, substantially parallel, opposite surfaces, each of said second and third structural members having respective, front and rear edge portions, and respective, left and right side edge portions;

ii) means rigidly connecting said rear edge portions of each of said second and third structural members to said first surface of said first structural member with said second and third structural members in spaced relation and said opposite surfaces of said second and third structural members substantially parallel to one another and perpendicular to said opposite surfaces of said first member;

iii) left and right support members, each extending between and rigidly connected to each of said second and third structural members respectively adjacent said left and right side edge portions thereof;

c) hinge means connecting said seat portion to said third structural member for 180° pivotal movement of said second rigid structure with respect to said first rigid structure between a first position, wherein said upper surface of said first seat portion and said first surface of said third structural member are substantially parallel and contiguous, and a second position, wherein said first surface of said third structural member opposes and rests upon said upper surface of said first seat portion; and d) a child seat removably mountable upon said second rigid structure in said first position thereof, said child seat including:

i) a second seat portion having a planar, lower surface resting upon said first surface of said third structural member;

ii) a back portion having a planar, rear surface adjacent said first surface of said first structural member;

iii) a pair of arm rests extending forwardly from said back portion and above said second seat portion; and iv) tab means extending downwardly from said back portion to a position contacting a retaining portion of said third structural member when said child seat is mounted upon said second rigid structure, thereby preventing forward movement of said child seat.

2. The furniture item of claim 1 wherein said tab means is integral with said back portion.

3. The furniture item of claim 2 wherein said tab means comprises a pair of tab members extending downwardly on opposite sides of said back portion.

4. The furniture item of claim 1 and further including an engagement portion extending rearwardly from said rear surface of said back portion and contacting said second surface of said first structural member, whereby said rear surface of said back portion is held in spaced relation to said second surface of said first structural member, thereby preventing rearward movement of said child seat.

5. The furniture item of claim 4 wherein said engagement portion extends integrally rearwardly from said second seat portion.

6. The furniture item of claim 4 wherein said third structural member retaining portion comprises at least one surface positioned a predetermined distance forwardly of said second surface of said first structural member.

7. The furniture item of claim 4 wherein said third structural member retaining portion comprises a pair of surface portions respectively extending inwardly from said left and right side edges of said third structural member.

8. The furniture item of claim 1 and further including a telephone stand fixedly connected to said first rigid structure laterally adjacent said first seat portion.

9. The furniture item of claim 8 wherein said stand includes a support surface substantially co-planar with said seat portion upper surface.

10. The furniture item of claim 8 and further including a compartment having lower, upper, front, rear and side members fixedly supported between said front and rear legs below said first seat portion, said upper member being moveable between open and closed positions.

11. A furniture item comprising:

a) first and second, hingedly connected, rigid structures for selective movement relative to one another between first, second and third positions wherein said item is adapted for use as a chair having a seat portion, an ironing board and a step ladder having a plurality of vertically spaced steps, respectively;

b) said first rigid structure including four legs having lower ends in a common plane and upper ends fixedly connected to said seat portion, the latter having an upper surface parallel to said common plane;

c) a telephone stand including a support surface; and d) means rigidly connecting said telephone stand to said first rigid structure with said support surface substantially parallel to said common plane and laterally adjacent said seat portion upper surface in all of said first, second and third positions.

12. The furniture item of claim 11 wherein said support surface is substantially co-planar with said seat portion upper surface.

13. The furniture item of claim 11 wherein said telephone stand is connected to at least one of said legs.

14. The furniture item of claim 11 and further including a compartment having lower, upper, front, rear and side members fixedly supported between opposed surfaces of said four legs.

15. The furniture item of claim 14 wherein said compartment upper member includes forward and rear sections, said rear section being fixedly mounted and said forward section being mounted for movement between open and closed positions.

16. The furniture item of claim 15 wherein said rear section forms the lower of said vertically spaced steps when said furniture item is in said third position.

17. The furniture item of claim 11 and further including a child seat removably mountable upon said seat portion when said furniture item is in said first position.

18. The furniture item of claim 17 and further including cooperable retaining means substantially preventing forward and rear movement of said child seat when mounted upon said furniture item.

* * * * *